US005557258A

United States Patent [19]

Eslambolchi

[11] Patent Number: 5,557,258

[45] Date of Patent: Sep. 17, 1996

[54] METHOD AND APPARATUS FOR WARNING OF POTENTIAL HARM TO AN UNDERGROUND UTILITY CONVEYANCE

[75] Inventor: Hossein Eslambolchi, Bedminster, N.J.

[73] Assignee: AT&T, Holmdel, N.J.

[21] Appl. No.: 430,652

[22] Filed: Apr. 28, 1995

[51] Int. Cl.[6] ..... G08B 13/00; G08G 1/04

[52] U.S. Cl. ..... 340/540; 340/539; 340/566; 340/943

[58] Field of Search ..... 340/540, 566, 340/539, 943

[56] References Cited

U.S. PATENT DOCUMENTS

| | | | |
|---|---|---|---|
| 3,435,405 | 3/1969 | Persson | 340/943 |
| 3,860,912 | 1/1975 | Romans | 340/539 |
| 4,158,832 | 6/1979 | Barnes, Jr. et al. | 340/943 |
| 4,363,031 | 12/1982 | Reinowitz | 340/539 |
| 4,652,861 | 3/1987 | Domes | 340/539 |
| 4,816,827 | 3/1989 | Baloutch et al. | 340/943 |
| 4,953,144 | 8/1990 | Chin et al. | 340/566 |
| 5,146,209 | 9/1992 | Beghelli | 340/691 |

*Primary Examiner*—Glen Swann
*Attorney, Agent, or Firm*—Robert B. Levy

[57] ABSTRACT

Potential harm to an underground utility conveyance (12), resulting from excavation by a backhoe (14) in the vicinity of the conveyance, is sensed by a sensor (32, 40, 42 or 44) that detects a disturbance attributable to the presence of the backhoe. In response to the sensor detecting such a disturbance, a control unit (34) triggers a warning device (36, 38) to generate a warning to alert the backhoe operator of the presence of the underground utility conveyance (12).

18 Claims, 1 Drawing Sheet

METHOD AND APPARATUS FOR WARNING OF POTENTIAL HARM TO AN UNDERGROUND UTILITY CONVEYANCE

TECHNICAL FIELD

This invention relates to a technique for warning of potential harm to an underground utility conveyance (i.e., a buried pipe or cable) resulting from possible excavation by a piece of excavating equipment in the vicinity of the conveyance.

BACKGROUND ART

Utilities that provide electric, gas, water and/or telephone service usually do so via a network of underground pipes and/or cables, hereinafter collectively referred to as "underground utility conveyances." To alert the public of the presence of such underground utility conveyances, most utilities usually mark the right-of-way of such conveyances with spaced-apart above-ground warning signs. Despite such warning signs, damage to underground utility conveyances still occurs, mostly as a result of inadvertent excavation by a contractor who is usually unaware of the presence of the underground utility conveyance.

Damage to an underground utility conveyance by inadvertent excavation has disastrous consequences. Depending on the damage inflicted, repairs to the underground utility conveyance can be very expensive. Further, while the underground utility conveyance is being repaired, service is usually disrupted to utility customers, resulting in lost revenues to the utility. Moreover, for underground utility conveyances that carry natural gas or other hazardous substances, inadvertent excavation may not only lead to pecuniary loss but personal injury as well.

Thus, there is a need for an improved technique for warning of potential harm to an underground utility conveyance by inadvertent excavation.

BRIEF SUMMARY OF THE INVENTION

Briefly, in accordance wire a preferred embodiment of the invention, a technique is provided for warning of potential harm to an underground utility conveyance by excavation by a piece of excavating equipment in the vicinity of the conveyance. The method is initiated by providing at least one sensor for sensing a disturbance (e.g., a seismic, acoustic, or physical disturbance) to the underground utility conveyance caused by the presence of a piece of excavating equipment in the vicinity of the conveyance. The sensor is monitored to determine if the disturbance is attributable to the presence of the excavating equipment and, if so, a warning is generated to warn the operator of the excavating equipment of the likelihood of potential harm to the underground utility conveyance should the operator commence excavation. The warning may be audible or visual, or both, such as the combination of a sharp sound (e.g., a siren) and flashing lights. As compared to a passive sign, such an audible and/or visual warning is far more likely to gain the attention of the operator of the excavation equipment. In this way, the operator is less likely to commence excavation in the vicinity of the underground utility conveyance, thereby avoiding potential harm to the conveyance.

DETAILED DESCRIPTION

Figure 1:
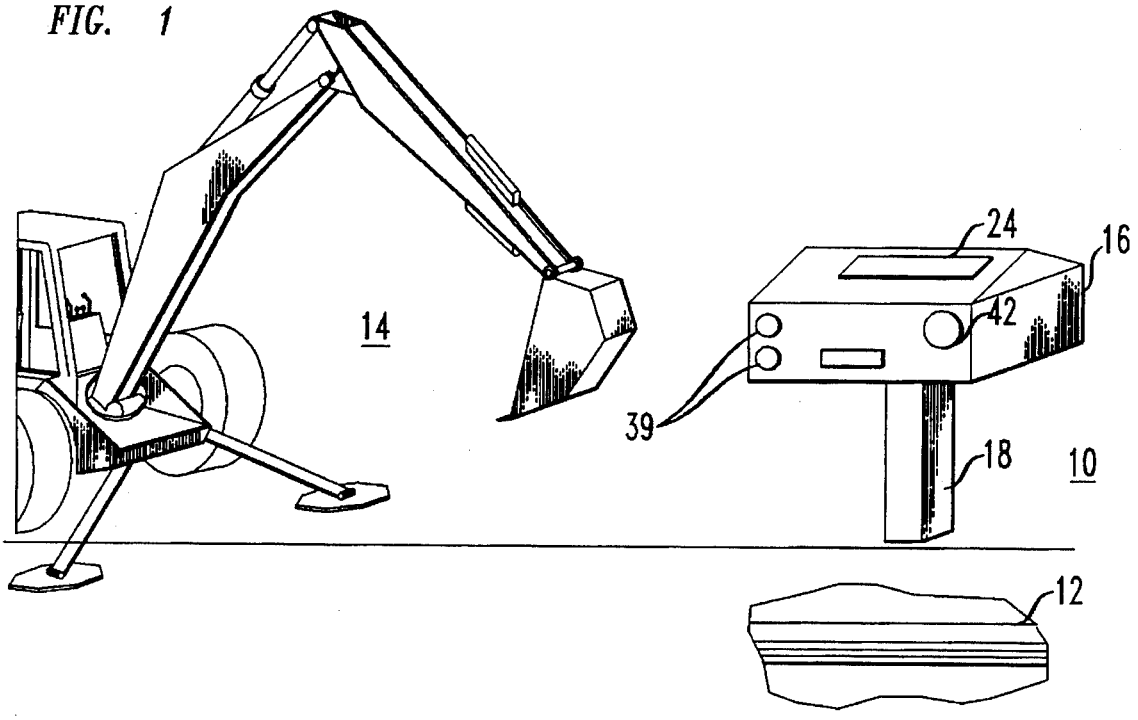
FIG. 1 shows an apparatus, in accordance with the present invention, for warning of potential harm to an underground utility conveyance by a piece of excavating equipment in the vicinity of the conveyance.

FIG. 1 shows a device 10, in accordance with a preferred embodiment of the invention, for warning of potential harm to an underground utility conveyance 12 from possible excavation by a piece of excavation equipment 14, illustratively shown as a backhoe, in the vicinity of the conveyance. In practice, the underground utility conveyance 12 may comprise a pipe for carrying water or gas. Alternatively, the underground utility conveyance 12 may comprise a cable for carrying electricity or telecommunications traffic. In addition to carrying water, gas, electricity or telecommunications traffic, the underground utility conveyance 12 typically carries a signal at a frequency specifically assigned to the utility responsible for maintaining the cable. For example, telecommunications cables that are maintained by AT&T Corp. carry a pulsed signal at a frequency of 440 Hz to identify them as belonging to AT&T.

Still referring to FIG. 1, the warning device 10 of the invention comprises a weather-tight housing 16 that is supported above ground level by at least one post 18 along the fight-of-way of the underground utility conveyance 12. The housing 16 encloses an electronic circuit 20, best illustrated in FIG. 2, for sensing a disturbance in the vicinity of the underground utility conveyance 12 indicative of the presence of the backhoe 14 and for generating an audible and/or visual warning of harm attributable to potential excavation by the backhoe.

Figure 2:
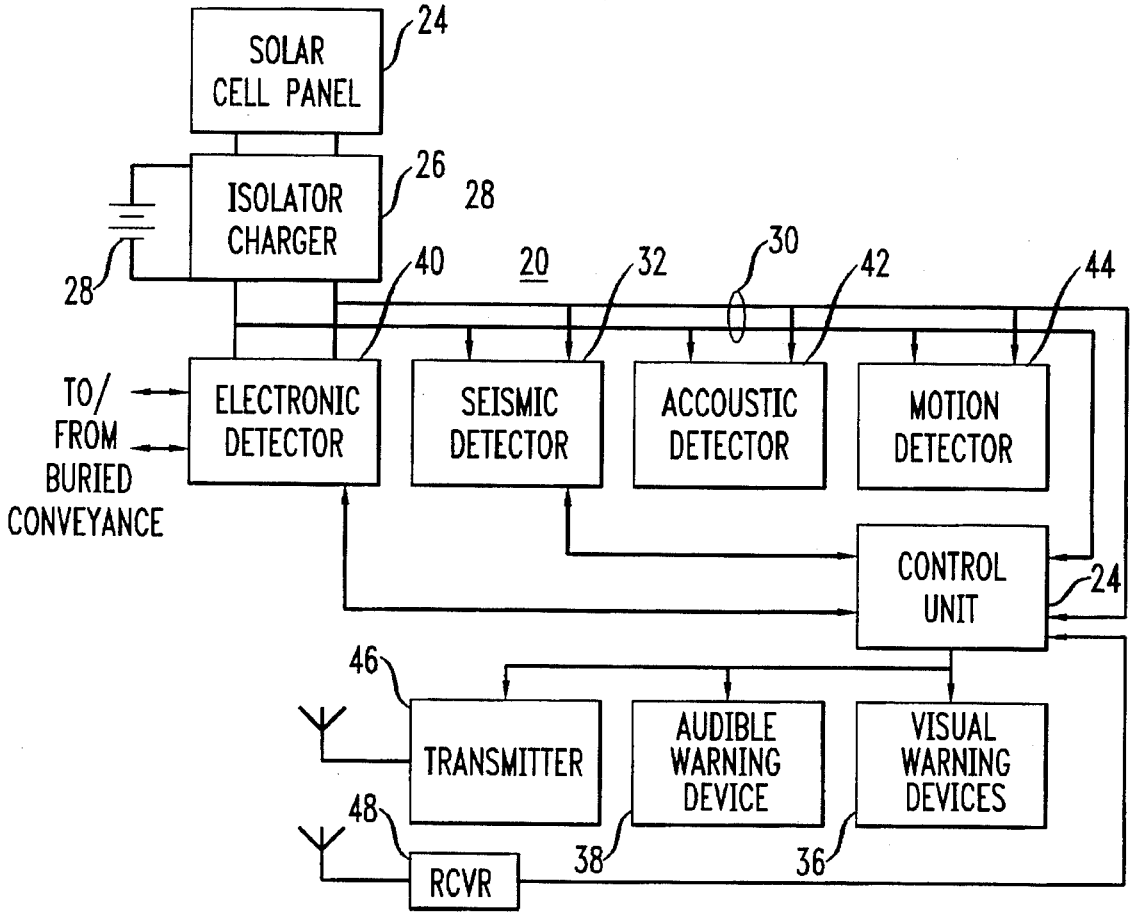
FIG. 2 is a block schematic diagram of the warning apparatus of FIG. 1.

Referring to FIG. 2, the electronic circuit 20 comprises a solar cell panel 24, mounted to the exterior of the housing 16 of FIG. 1, for generating a DC voltage when the panel is illuminated by sunlight directed at the housing. The solar cell panel 24 of FIG. 2 is coupled to an isolator-charger circuit 26 that couples the panel to at least one rechargeable battery 28 that provides a DC voltage across a DC power bus 30. During intervals when there is sufficient sunlight so that the solar cell panel 24 produce a prescribed DC voltage that exceeds the voltage of the battery 28, the isolator-charger couples the solar cell panel 24 to the bus 30. At the same time, the solar cell panel 24 provides the battery 28 with a trickle charge to maintain the battery fully charged. During intervals when the voltage produced by the solar cell panel 24 is insufficient to charge the battery 28 (as occurs at night, or on a cloudy day), the isolator-charger circuit 26 disconnects the solar cell panel from the battery 28 and from the bus 30.

As seen in FIG. 2, the circuit 20 includes a seismic detector 32, typically a suitable strain transducer, that is buried in proximity to the underground utility conveyance 12 of FIG. 1. The seismic detector 32 is coupled to the power bus 30 and operates to sense any seismic disturbance that may be caused by the presence of the backhoe 14 of FIG. 1 in the vicinity of the underground utility conveyance 12 of FIG. 1. The seismic detector 32 is coupled to a control unit 34, typically in the form of a microprocessor, or a dedicated logic circuit that is also powered by the bus 30. The control unit 34 serves to actuate either a visual warning device 36 or an audible warning device 38, or both, in response to the detection of the backhoe 14 of FIG. 1 in the vicinity of the underground utility conveyance 12 by the seismic detector 32. The visual warning device 36 includes at least one strobe or flashing light 39 of FIG. 1 that is mounted on, or is visible through, the housing 16 of FIG. 1 for warning the operator of the backhoe 14 that commencing excavation may harm the underground utility conveyance 12. The audible warning device 38 typically includes a siren 42 (see FIG. 1) or another type of sound-producing device mounted to the housing 16 so the sound generated by the device is audible for some distance beyond the housing for warning the backhoe operator that commencing excavation may harm the underground utility conveyance 12. Rather than utilize the siren 42 of FIG. 1, the audible warning device 38 could comprise a weather-resistant loudspeaker (not shown) driven by a voice synthesizer or tape recorder (not shown) to provide a vocal warning that excavation may damage the underground utility conveyance 12 of FIG. 1.

Rather than rely strictly upon the seismic detector 32, the circuit 20 may include an electronic detector 40 coupled to the bus 30. The electronic detector 40 typically comprises a frequency comparator coupled to the underground utility conveyance 12 of FIG. 1 for sensing the frequency of the signal carried by the conveyance. As described previously, the underground utility conveyance 12 of FIG. 1 typically carries a signal at a specific frequency for identification purposes. This signal will vary from its nominal frequency when the underground utility conveyance 12 is subjected to vibration, such as that caused by the backhoe 14 of FIG. 1 when in the vicinity of the conveyance. Should the detector 40 detect a variation in the frequency of the signal carded by the underground utility conveyance 12, then the detector alerts the control unit 34 of such a variation.

When both the seismic detector 32 and the electronic detector 40 are present, the control unit 34 typically maintains the electronic detector 40 in a quiescent (i.e., de-energized) state until the seismic detector 32 detects a seismic disturbance attributable to the presence of the backhoe 14 of FIG. 1. Once the seismic detector 32 detects such a seismic disturbance, then the control unit 34 energizes the electronic detector 40, typically for a short interval (e.g., fifteen minutes), to monitor the signal carded by the underground utility conveyance 12 to detect variations in its frequency. Should the electronic detector 40 detect a variation in the frequency of the signal carried by the underground utility conveyance 12, then the detector alerts the control unit 34 of such a variation, whereupon the control unit triggers the visual and audible warning devices 36 and 38, respectively. In this way, the incidence of false alarms is reduced, as compared to the use of the seismic detector 32 alone. Moreover, the charge on the battery 28 is conserved by maintaining the electronic detector 40 in a quiescent state until the presence of the backhoe 14 is possibly detected by the seismic detector 32.

In addition to, or in place of, the seismic detector 32 and/or the electronic detector 40, the circuit 20 may include either an acoustic detector 42 and/or a motion detector 44, both coupled to the control unit 34 and both powered from the bus 30. The acoustic detector 42 comprises an acoustic transducer, such as a microphone (not shown) coupled to a filter circuit (not shown) responsive to the frequency of the of the engine (not shown) of the backhoe 14 of FIG. 1. In practice, the backhoe 14, as with most other types of excavating equipment, is powered by a diesel engine (not shown) that operates at a frequency of about 16.6 Hz. By adjusting the acoustic detector 42 to this frequency or one of its harmonics, the detector can detect the presence of the backhoe 14 and alert the control unit 34 accordingly.

The motion detector 44 typically comprises an ultrasonic device for radiating an ultrasonic signal beyond the housing 16 of FIG. 1 and for detecting any reflection of that signal that may be attributable to a large object (e.g., the backhoe 14) in the vicinity of the housing 16. Should the motion detector 44 detect a reflection of the ultrasonic radiation attributable to the presence of the backhoe 14 of FIG. 1, then the detector would alert the control unit 34 accordingly.

In addition to the visual and audible warning devices 36 and 38, respectively, the circuit 20 may advantageously include a transmitter 46 that is triggered simultaneously with the warning devices for transmitting a warning signal. In practice, the transmitter 46 is configured to transmit RF signals to a central station. Alternatively, the transmitter 46 could easily be configured to transmit signals across another type of communications channel, such as a wire or optical fiber.

In addition to the transmitter 46, the circuit 20 may also include a receiver 48 designed to receive signals from the transmitter (not shown) of another warning device. Thus, rather than configure the transmitter 46 of the warning device 10 to have sufficient power to transmit a signal directly to the central station, the transmitter need only be strong enough to radiate a signal to a downstream warning device 10. Upon receipt of the signal from the transmitter of the upstream warning device (not shown), the receiver 48 of FIG. 2 would signal the control unit 34 to actuate the transmitter 46. In this way, a successive downstream warning device 10 would act as a relay station for an upstream warning device located further along the fight-of-way of the underground utility conveyance 12.

The foregoing describes a device 10 for warning of potential harm to an underground utility conveyance 12 by excavation by a backhoe 14 or another piece of excavating equipment.

It is to be understood that the above-described embodiment is merely illustrative of the principles of the invention. Various modifications and changes may be made thereto by those skilled in the an which will embody the principles of the invention and fall within the spirit and scope thereof. For example, while the circuit 20 of FIG. 2 has been described as including the detectors 32, 40, and 44, for sensing different kinds of disturbances, it should be understood that only a single detector is all that is necessary to practice the invention.

What is claimed is:

1. A method of warning of potential harm to a underground utility conveyance, comprising the steps of:

providing at least one sensor for sensing a disturbance attributable to the presence of a piece of excavating equipment in proximity to the utility conveyance;

monitoring the sensor to detect the occurrence of such a disturbance and in response thereto;

generating a warning at the location of the buried underground utility conveyance, the warning directed to an operator of the piece of excavating equipment to warn of potential harm to the buried underground utility conveyance.

2. The method according to claim 1 wherein the disturbance that is sensed is a seismic disturbance.

3. The method according to claim 1 wherein the disturbance that is sensed is an acoustic disturbance.

4. The method according to claim 1 wherein the disturbance that is sensed is a motion disturbance.

5. The method according to claim 1 wherein the warning comprises an audible warning.

6. The method according to claim 1 wherein the warning comprises a visual warning.

7. The method according to claim 1 wherein the warning comprises both an audible and a visual warning.

8. The method according to claim 1 wherein the step of generating a warning includes the step of transmitting a signal indicative of potential harm to the underground utility conveyance.

9. A method of warning of potential harm to a underground utility conveyance, comprising the steps of:

applying a signal to the underground utility conveyance;

providing at least one sensor for sensing a disturbance attributable to the presence of a piece of excavating equipment in proximity to the utility conveyance wherein the disturbance that is sensed is a variation in the frequency of the signal applied to the underground utility conveyance;

monitoring the sensor to detect the occurrence of such a disturbance and in response thereto; and generating a warning at the location of the buried underground utility conveyance, the warning being directed to an operator of the piece of excavating equipment to warn of potential harm to the buried underground utility conveyance.

10. A method of warning of potential harm to an underground utility conveyance, comprising the steps of:

applying a signal at a prescribed frequency to the underground utility conveyance;

providing at least one sensor for sensing a seismic disturbance attributable to the presence of a piece of excavating equipment in proximity with the underground utility conveyance;

monitoring the sensor to detect a seismic disturbance and in response thereto, then monitoring the signal on the utility conveyance to determine if the signal varies in a manner consistent with excavation in proximity to the underground utility conveyance; and generating an audible and visual warning at the location of the buried underground utility conveyance and being directed to an operator of the piece of excavating equipment if the signal on the underground utility conveyance varies in a manner consistent with excavation in proximity to the utility conveyance.

11. Apparatus for warning of potential harm to an underground utility conveyance, comprising:

at least one sensor for sensing a disturbance attributable to the presence of a piece of excavating equipment in proximity to the underground utility conveyance;

control means for monitoring the sensor to detect the occurrence of the disturbance; and warning means at the location of the buried underground utility conveyance and coupled to the control means for generating a warning directed to the operator of the piece of excavating equipment in response to the disturbance.

12. The apparatus according to claim 11 wherein the sensor comprises a seismic sensor.

13. The apparatus according to claim 11 wherein the sensor comprises an acoustic sensor.

14. The apparatus according to claim 11 wherein the sensor comprises a motion sensor.

15. The apparatus according to claim 11 wherein the warning means generates an audible warning.

16. The apparatus according to claim 11 wherein the warning means generates a visual warning.

17. The apparatus according to claim 11 further including a transmitter responsive to the control means for transmitting a warning signal.

18. Apparatus for warning of potential harm to an underground utility conveyance, comprising:

at least one frequency comparator for sensing a disturbance attributable to the presence of a piece of excavating equipment in proximity to the underground utility conveyance by sensing variations in a fixed frequency signal applied to the underground utility conveyance;

control means for monitoring the sensor to detect the occurrence of the disturbance; and warning means at the location of the buried underground utility conveyance and coupled to the control means for generating a warning directed to the operator of the piece of excavating equipment in response to the disturbance.

* * * * *